US008482587B2

(12) United States Patent
Sakaino

(10) Patent No.: US 8,482,587 B2
(45) Date of Patent: Jul. 9, 2013

(54) PORTABLE PRINTER

(75) Inventor: Tsuyoshi Sakaino, Higashikurume (JP)

(73) Assignees: Citizen Holdings Co., Ltd., Tokyo (JP); Citizen Systems Japan Co., Ltd., Tokyo (JP)

( * ) Notice: Subject to any disclaimer, the term of this patent is extended or adjusted under 35 U.S.C. 154(b) by 62 days.

(21) Appl. No.: 13/188,625

(22) Filed: Jul. 22, 2011

(65) Prior Publication Data

US 2012/0050448 A1 Mar. 1, 2012

(30) Foreign Application Priority Data

Aug. 26, 2010 (JP) ..... 2010-189507

(51) Int. Cl.
*B41J 3/36* (2006.01)

(52) U.S. Cl.
USPC ..... 347/222

(58) Field of Classification Search
USPC ..... 347/222
See application file for complete search history.

(56) References Cited

U.S. PATENT DOCUMENTS 7,287,850 B2 * 10/2007 Matsui et al. ..... 347/109
7,825,944 B2 * 11/2010 Kaiya ..... 347/222

FOREIGN PATENT DOCUMENTS

JP 2001-130057 * 1/2001
JP 2001-199122 A 7/2001
JP 2002-23255 A 1/2002
JP 2005-88350 A 4/2005
JP 2005-288992 A 10/2005
JP 2006-347088 * 12/2006

OTHER PUBLICATIONS

Machine-generated translation of JP 2006-347088, published on Dec. 2006.*

* cited by examiner

*Primary Examiner* — Huan Tran

(57) ABSTRACT

The invention provides a portable printer wherein provisions are made to prevent rain drops or dust particles from entering the interior of a body case through a paper exit port of the printer when a person carrying the portable printer in an exposed manner, for example, on his or her waist, is caught in rain or passes through a dusty area, and provisions are also made to ensure that power to the portable printer is turned off when not in use. More specifically, the invention provides a portable printer comprising: a body case having a paper storage section for storing paper; a storage cover swingably attached to the body case in order to open and close the paper storage section; a paper exit cover for opening and closing a paper exit port formed between the body case and the storage cover; and a control unit for controlling ON/OFF of power to the portable printer in conjunction with the opening and closing of the paper exit cover, wherein the control unit turns off power to the portable printer when the paper exit cover is set to close the paper exit port.

9 Claims, 9 Drawing Sheets

PORTABLE PRINTER

The entire content of Japanese Patent Application No. 2010-189507 is hereby incorporated by reference.

FIELD OF THE INVENTION

The present invention relates to a paper exit cover for a portable printer.

BACKGROUND OF THE INVENTION

When taking a meter reading for billing of electricity or gas charges, a bill collector who reads the meter may at the same time enter the data into a portable printer and issue a receipt on the spot. In that case, the bill collector saves the entered data and the issued receipt data into the portable printer. The saved data are retrieved later using a personal computer or the like and processed. A portable printer having such a function is often used outdoors by home-delivery service personnel, sales personnel, etc. This type of printer is equipped with a paper exit port through which printed paper is ejected, for example, in order to issue a receipt or the like. The paper exit port is usually not covered. Consequently, when the person carrying the printer is caught in rain or passes through a dusty area, rain drops or dust particles may enter the interior of the machine through the paper exit port, adversely affecting the internal electronic precision parts, causing the moving parts to malfunction, or allowing the paper to get wet, resulting in a printing failure.

Further, since this type of portable printer is operated by a battery, the power switch has to be turned on and off constantly. However, as is often the case, the operator may forget to turn off the power switch when he or she is busy.

Patent document 1 discloses a portable electronic apparatus which aims to prevent printed recording paper from getting wet by storing the printed recording paper inside a drip-proof cover as the printed paper is fed out in continuous form. For this purpose, the drip-proof cover is mounted so as to cover an area extending from an upper face of a body case 1, where the paper exit port is provided, to a lower face of the body case 1 by passing the rear of a paper holder 13, and the printed recording paper is stored inside the cover. Accordingly, the portable electronic apparatus disclosed in patent document 1 can prevent rain drops from entering the interior through the paper exit port even if the apparatus is exposed to some rain. However, the disadvantage is that the printed recording paper cannot be seen directly unless the drip-proof cover is opened. JP2001-130057 cited in patent document 1 also discloses a portable electronic apparatus having a similar storage cover, in which the position of the axis about which the storage cover is turned to open and close is located closer to the wrist, thereby aiming to improve operability when the storage cover is opened.

Patent document 2 discloses a small portable printer, in which the interior of the printer case is partitioned by a drip-proof wall 12 between a directly underneath area 8 and a drip-proof area 9, the structure being such that any liquid entering the directly underneath area 8 through a paper exit port 6 formed in the front surface of the printer case is prevented from entering the drip-proof area 9 but is drained to the outside through a liquid exit port formed in the bottom of the printer case. The technical idea of the small portable printer disclosed in patent document 2 is to protect important internal parts from the infiltration of rain drops by providing the drip-proof wall 12, while allowing the rain drops infiltrating through the paper exit port to pass through the interior of the printer case and drain to the outside through the bottom, but the structure is not intended to prevent the infiltration of rain drops.

Patent document 3 discloses a printer in which a cover 12 for opening and closing a print paper exit port is related with a printer operation button so that the printer can operate only after the printer is set ready for operation by opening the cover 12. The small portable printer disclosed in patent document 3 thus prevents erroneous print operations.

Patent document 4 discloses a printer in which the sliding operation of a slide cover provided on a main body 13 is related with the operation of a print button so that the print button 18 cannot be operated unless the slide cover is slid into a print position. The small portable printer disclosed in patent document 4 thus prevents erroneous print operations.

Patent document 1: JP2005-288992-A
Patent document 2: JP2005-88350-A
Patent document 3: JP2001-199122-A
Patent document 4: JP2002-23255-A

SUMMARY OF THE INVENTION

The invention provides a portable printer wherein provisions are made to prevent rain drops or dust particles from entering the interior of the body case through the paper exit port of the printer when a person carrying the portable printer in an exposed manner, for example, on his or her waist, is caught in rain or passes through a dusty area, and provisions are also made to ensure that power to the portable printer is turned off when not in use.

The portable printer includes a body case having a paper storage section for storing paper; a storage cover rotatably attached to the body case in order to open and close the paper storage section, a paper exit cover for opening and closing a paper exit port formed between the body case and the storage cover, and a control unit for controlling ON/OFF of power to the portable printer in conjunction with the opening and closing of the paper exit cover, wherein the control unit turns off power to the portable printer when the paper exit cover is set to close the paper exit port.

Preferably, the portable printer is constructed so that when the storage cover is closed, a front surface of the body case forms substantially the same plane as a front surface of the storage cover.

Preferably, in the portable printer, the paper exit cover is attached to the body case so as to be slidable along the body case.

Preferably, in the portable printer, the paper exit cover is attached to the storage cover so as to be slidable along the storage cover.

Preferably, the portable printer further includes a hand cutter blade attached to an edge of the body case or to an edge of the paper exit cover.

Preferably, the portable printer further includes a warning unit which issues a warning at predetermined intervals when the paper exit cover is set to open the paper exit port.

More specifically, the portable printer is a portable printer whose printer case is made of a body case having a paper storage section for holding a paper roll and a storage cover for opening and closing the paper storage section, wherein the storage cover is rotatably attached to the body case and, when the storage cover is closed, the front surface of the body case forms substantially the same plane as the front surface of the storage cover, thus forming a portion of the front face of the printer case, and wherein a paper exit cover capable of opening and closing the paper exit port is attached to a portion of the front face so as to be slidable along the portion of the front face, and the ON/OFF operation of the power to the portable printer is conjunction with the open/close operation of the paper exit cover so that when the paper exit port is closed, the power to the portable printer is turned off.

Even when the person carrying the portable printer in an exposed manner, for example, on his or her waist, is caught in rain or passes through a dusty area, since the paper exit port is closed, rain drops, etc., do not enter the interior of the printer case, and thus the functions of the portable printer can be safely maintained. Furthermore, since the power is always turned off when the paper exit port is closed, the battery charge per charge can be prolonged.

DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENT

FIGS. 1 to 7 are diagrams for explaining a portable printer 1.

Figure 1:
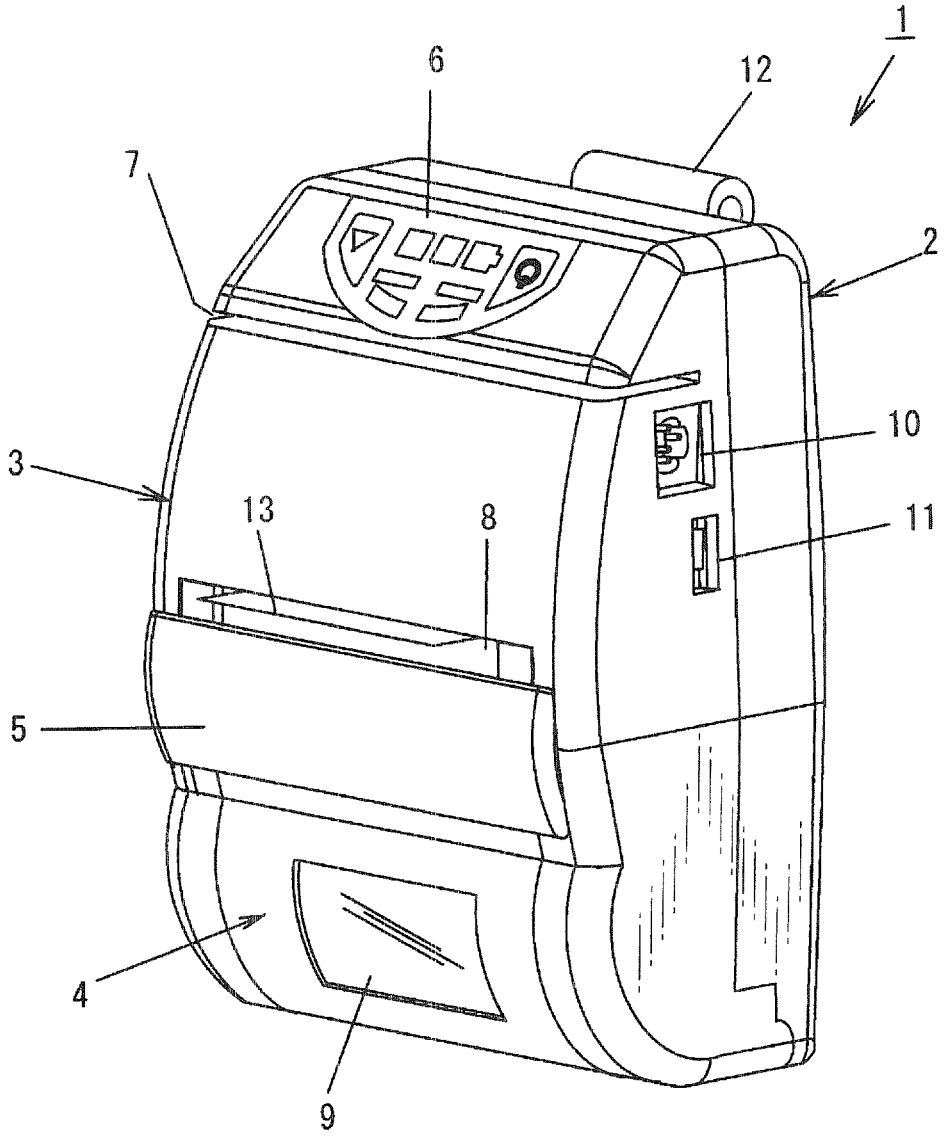
FIG. 1 is a perspective view of a portable printer 1 as viewed from the front thereof.

FIG. 1 is a diagram showing the portable printer 1 in its entirety, as viewed from the front thereof.

A printer case 2 comprises a body case 3 having a paper storage section for storing a paper roll, a storage cover 4, and a paper exit cover 5.

The body case 3 is provided on its front face with an operation panel 6, a magnetic card insertion slit 7, and a paper exit port 8 in this order from the top. A serial I/F connector 10 and a USB I/F connector 11 for connection with a host apparatus are provided on the right side face of the body case 3. The storage cover 4 is provided with a cover window 9 formed from a transparent material. The paper exit cover 5 is mounted in the center of the front face of the printer case 2. A belt clip 12 is attached to the rear of the body case 3. FIG. 1 shows the condition in which printed paper 13 is being ejected through the paper exit port 8.

Figure 2:
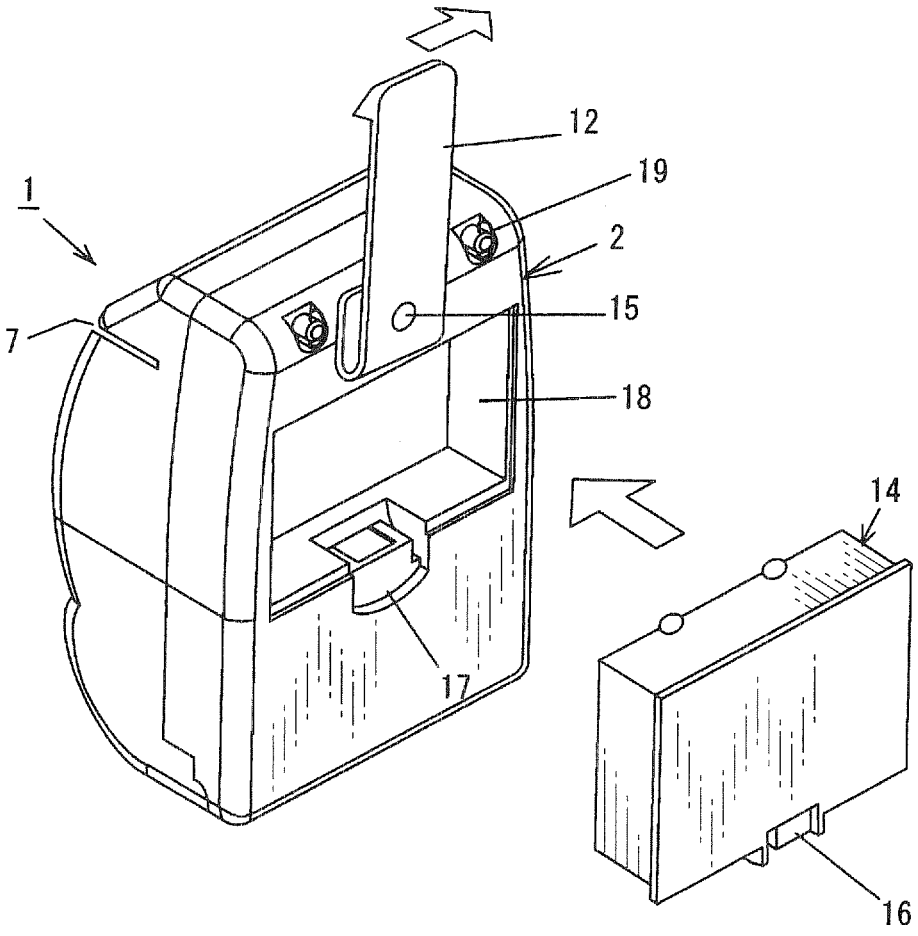
FIG. 2 is a perspective view of the portable printer 1 from which a battery has been removed, as viewed from the rear thereof.

FIG. 2 is a diagram showing the portable printer 1 in its entirety, as viewed from the rear thereof.

FIG. 2 shows the condition in which a battery 14 is removed. The battery 14 can be easily installed by pushing the battery 14 into a battery compartment 18 in the rear of the printer case 2 and engaging a lower end hook 16 onto an engaging portion 17 in the rear of the printer case 2. The belt clip 12 is used to fit the portable printer 1 onto a belt worn around the waist, and is rotatable about a mounting axis 15. The belt clip 12 is rotated downward for use after the battery 14 has been placed into the battery compartment 18 in the rear of the printer case 2. A strap hook 19 is used to attach a shoulder strap or the like.

Figure 3:
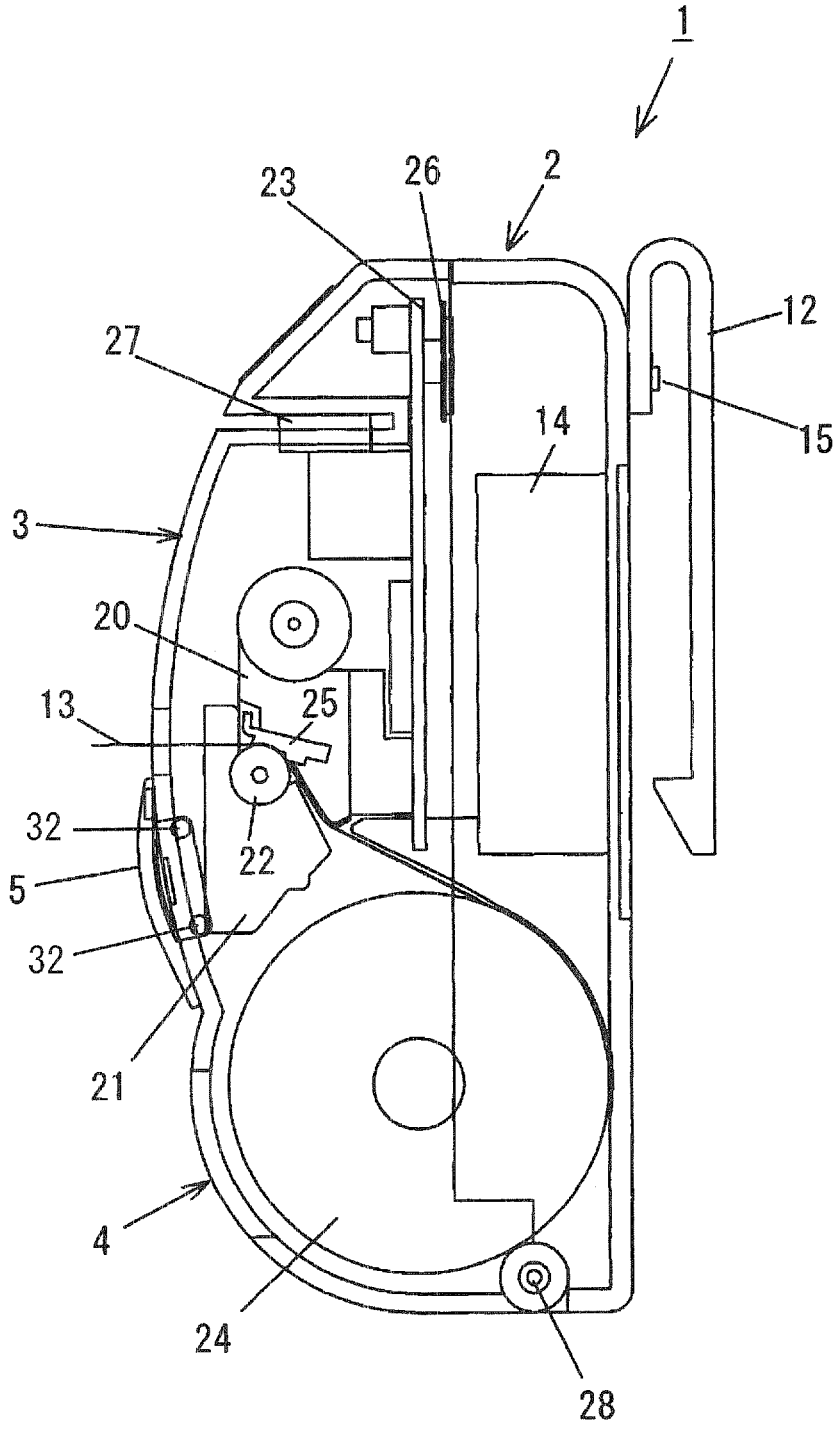
FIG. 3 is a schematic elevation view of the right side of the portable printer 1, revealing the internal construction thereof.

FIG. 3 is a schematic elevation view of the right side of the portable printer, revealing the internal construction thereof.

As shown in FIG. 3, a printer unit 20, a cutter unit 21, a platen 22, a control circuit board 23, and a paper roll 24 are housed inside the printer case 2. The lower part of the body case 3 forms the storage section for storing the paper roll 24, and the storage cover 4 is mounted so as to be able to open and close the storage section. The printer unit 20 has a print head 25 which is a thermal head, but the head is not limited to this particular type of head. The printer unit 20 and the cutter unit 21 are respectively commercially available units. Various other components necessary for the operation of the portable printer 1 are arranged inside the printer case 2, but they are not shown here.

Figure 4:
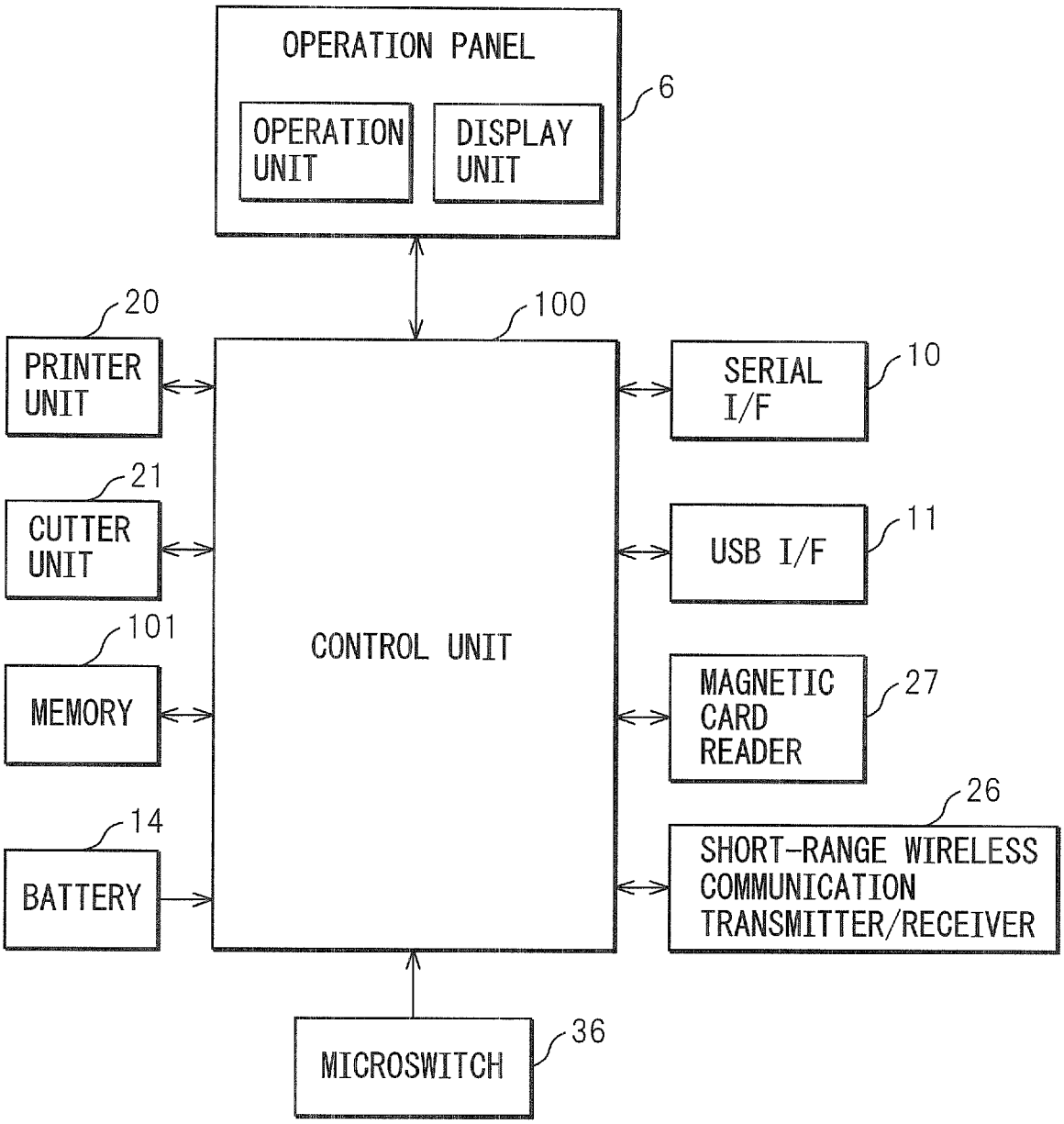
FIG. 4 is a schematic diagram of a control circuit mounted in the portable printer 1.

FIG. 4 is a schematic diagram of a control circuit mounted in the portable printer 1.

As shown in FIG. 4, a control unit 100 which includes a CPU, ROM, RAM, etc., mounted on the control circuit board 23 executes prescribed printing operations by controlling the printer unit 20 and the cutter unit 21 in accordance with operation commands entered from an operation unit provided on the operation panel 6. The control unit 100 also produces a visual display of prescribed printing operations, warnings, etc., on a display unit provided on the operation panel 6. Further, the control unit 100 is connected to a short-range wireless communication (Bluetooth) transmitter/receiver 26 and a magnetic card reader 27 provided inside the magnetic card insertion slit 7, as well as to the serial I/F connector 10 and the USB I/F connector 11, and controls data inputs and outputs to and from them.

The control unit 100 can record in a memory 101 the data input from or to be output to the serial I/F connector 10, the USB I/F connector 11, the short-range wireless communication transmitter/receiver 26, and the magnetic card reader 27. The control unit 100 can also detect the remaining capacity of the battery 14 and produce a battery level indication or low battery warning on the display unit of the operation panel 6. Further, the control unit 100 can detect the remaining amount of the paper roll 24 using a sensor not shown and produce a paper roll indication or warning on the display unit of the operation panel 6.

As will be described later, the control unit 100 performs control so that when the storage cover 4 is closed, and when the paper exit cover 5 is moved downward, causing a microswitch 36 to turn on (see FIG. 8), the power to the portable printer 1 is turned on and, when the microswitch 36 is turned off, the power to the portable printer 1 is turned off.

Figure 5:
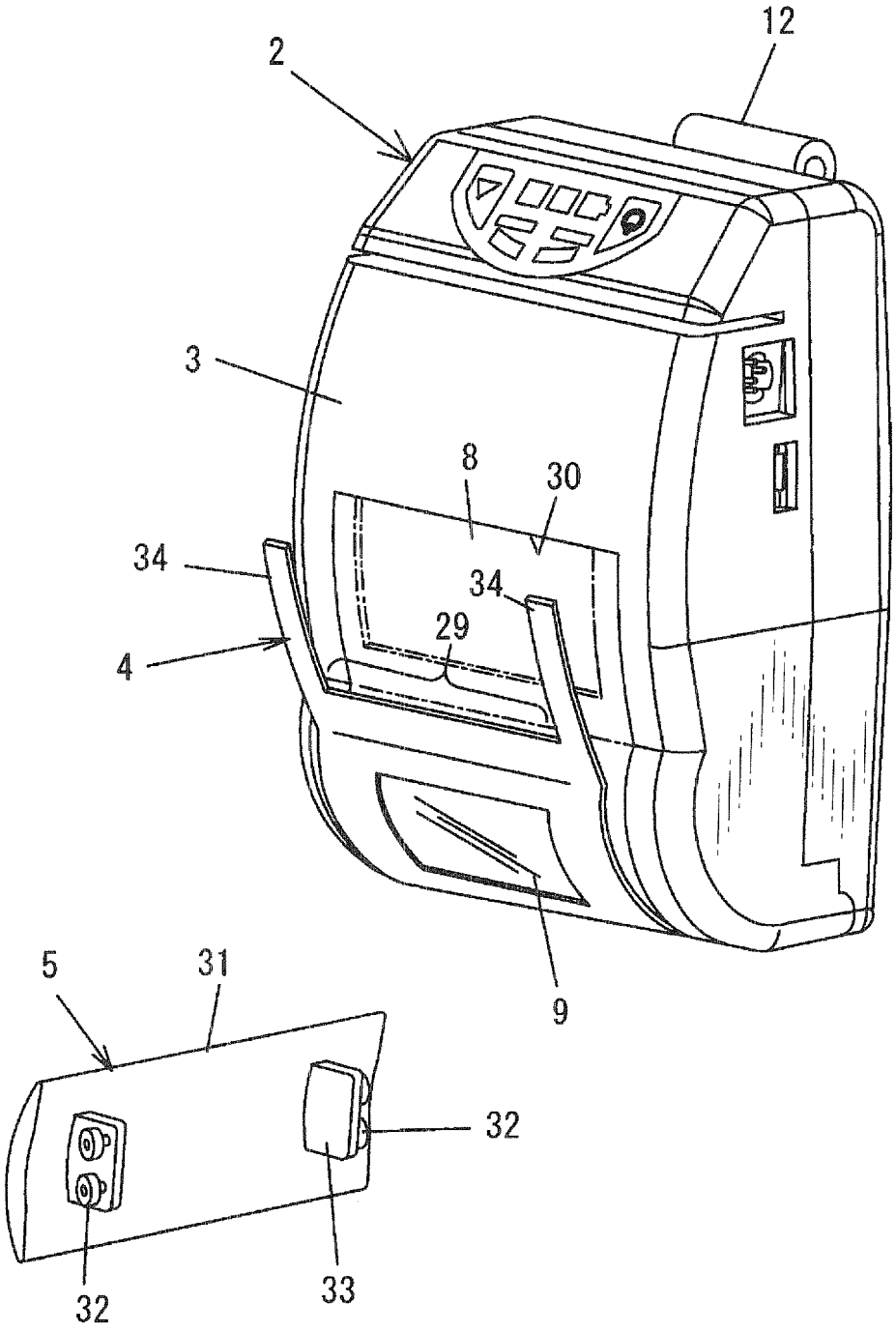
FIG. 5 is a perspective view of the portable printer 1, showing the condition in which a paper exit cover is removed.

FIG. 5 is a perspective view of the portable printer, showing the condition in which the paper exit cover is removed.

As shown in FIG. 5, the printer case 2 is made up of the body case 3, the storage cover 4, and the paper exit cover 5.

Figure 6:
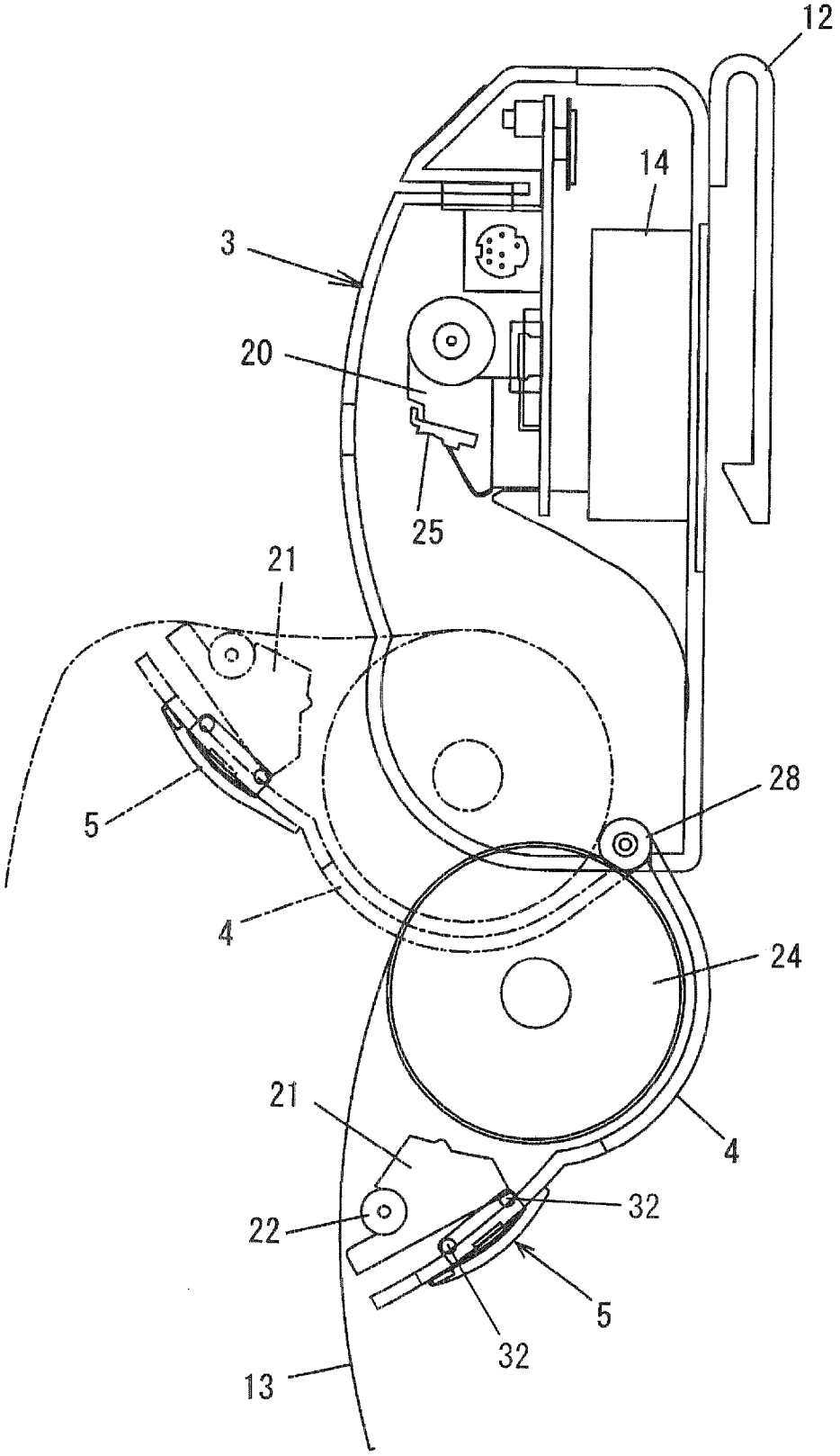
FIG. 6 is a diagram showing how a storage cover is opened and closed.

FIG. 6 is a diagram showing how the storage cover is opened and closed.

As shown in FIG. 6, the storage cover 4 is constructed so that it can be opened and closed on the body case 3 by turning upward and downward about an axis 28 located at the lower end on the front side of the printer case 2. When the storage cover 4 is closed, its surface is flush with the front face of the body case 3 and thus forms, together with the front face of the body case 3, a portion of the front face of the printer case 2.

The printer case 2 is a clamshell type, and the cutter unit 21 and the platen 22 are mounted on the inside surface of the storage cover 4. When the storage cover 4 is opened, the cutter unit 21 and the platen 22 are separated from the printer unit 20 and move into an open position together with the storage cover 4. When the storage cover 4 is closed, the platen 22 moves into a position where it presses the paper drawn out of the paper roll 24 onto the print head so that printing can be made on the paper.

Further, when the storage cover 4 is closed, the paper exit port 8 is formed between it and the body case 3 (see FIG. 5). That is, a rectangular cutout 29 formed by downwardly cutting the center area of the upper portion of the storage cover 4 combines with an exit port edge 30 on the body case 3 side, thereby defining the paper exit port 8. When the paper exit cover 5 is mounted, the paper exit port 8 is defined between the exit port edge 30 on the body case 3 side (the edge of the body case that forms the upper edge of the paper exit port) and an upper edge 31 of the paper exit cover 5 (the edge of the paper exit cover that forms the lower edge of the paper exit port) (see FIG. 1).

The paper exit cover 5 is attached to the front face of the storage cover 4 (see FIGS. 1 and 5). The paper exit cover 5 is a plate-like member whose width is substantially equal to that of the front face of the printer case 2 and whose horizontal and vertical dimensions are large enough to cover the paper exit port 8, and is provided with rollers 32 at both ends on its inside surface. The rollers 32 are rotatably mounted in pairs on support plates 33 formed in protruding fashion and spaced apart from each other by a distance substantially equal to the width of the rectangular cutout 29 of the storage cover 4. Each roller 32 is mounted on the outwardly facing side of each of the support plates 33 so that when the paper exit cover 5 is attached to the storage cover 4, the rollers 32 engage with wall portions 34 at both ends of the rectangular cutout 29 and allow the paper exit cover 5 to move up and down.

Figure 7:
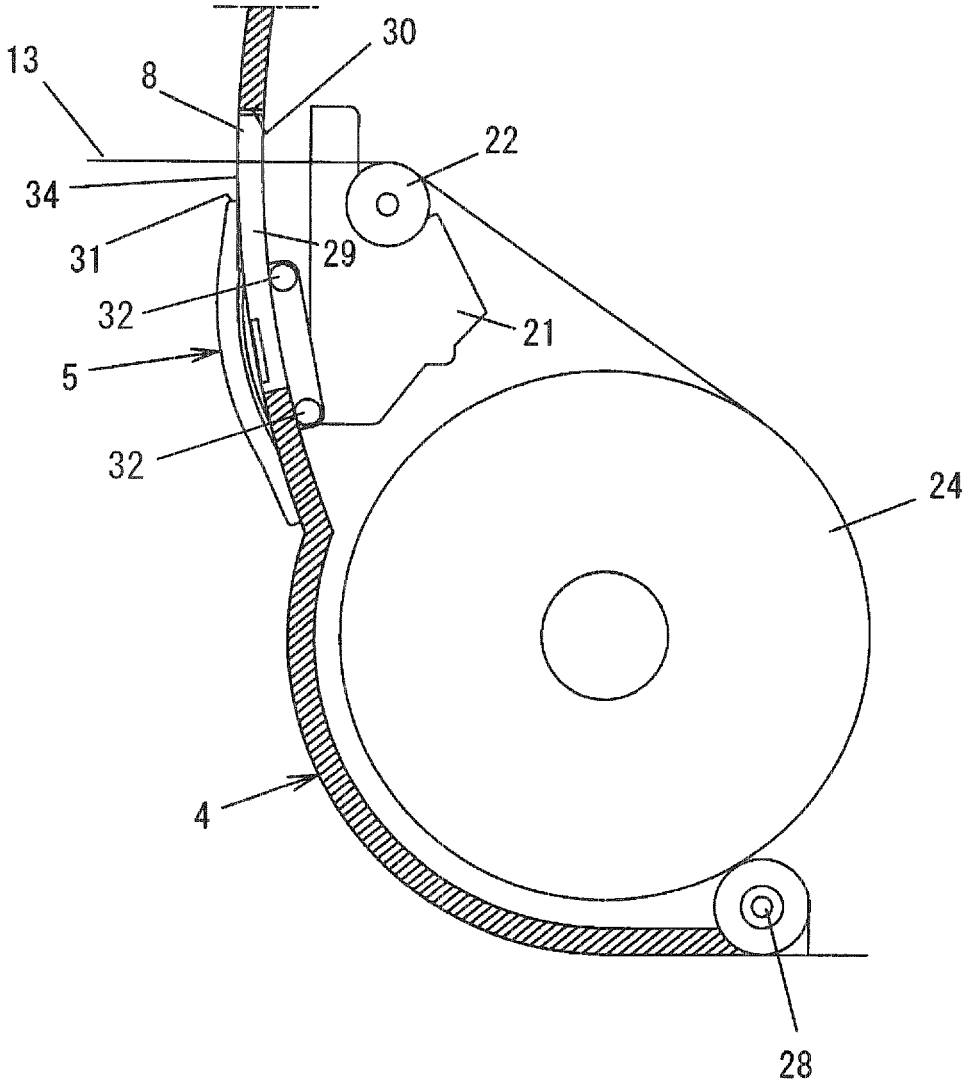
FIG. 7 is a diagram showing the condition in which the paper exit cover 5 is fitted into a rectangular cutout 29 formed in the storage cover 4.

FIG. 7 is a diagram showing the condition in which the paper exit cover 5 is fitted into the rectangular cutout 29 of the storage cover 4.

In FIG. 7, the paper exit cover 5 is moved downward to expose the paper exit port 8, allowing the printed paper 13 to be fed out through the exposed paper exit port 8. The paper exit cover 5 is mounted in such a manner as to hold the wall portions 34 of the storage cover 4 between the plate-like member of the paper exit cover 5 and the rollers 32. From this condition, when the paper exit cover 5 is pushed upward, the paper exit cover 5 moves upward by sliding along the wall portions 34 at both ends and closes the paper exit port 8.

Figure 8:
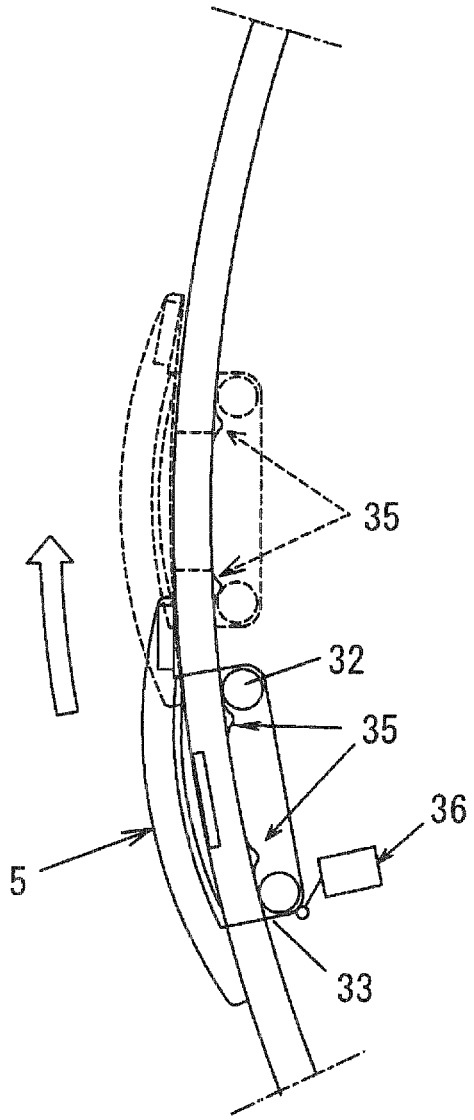
FIG. 8 is a diagram showing how the paper exit cover is moved.

FIG. 8 is a diagram showing how the paper exit cover is moved.

The upper and lower positions of the paper exit cover 5 are determined by projections 35 formed on the inside faces of the two wall portions 34. When the paper exit cover 5 is moved into the lower position, the microswitch 36 is turned on, and when the paper exit cover 5 is moved into the upper position, the microswitch 36 is turned off. The OFF state of the microswitch 36 indicates that the power to the portable printer 1 is OFF. That is, the control unit 100 performs control so that when the paper exit port 8 is closed by the paper exit cover 5, that is, when the portable printer 1 is not in use, the power to the portable printer 1 is always OFF (see FIG. 4).

The control circuit board 23 includes a control unit (not shown) that causes a red warning lamp to flash at predetermined intervals of time when the portable printer 1 is in use, thus reminding the operator to close the paper exit cover 5 when the portable printer 1 is actually not in use.

Figure 9:
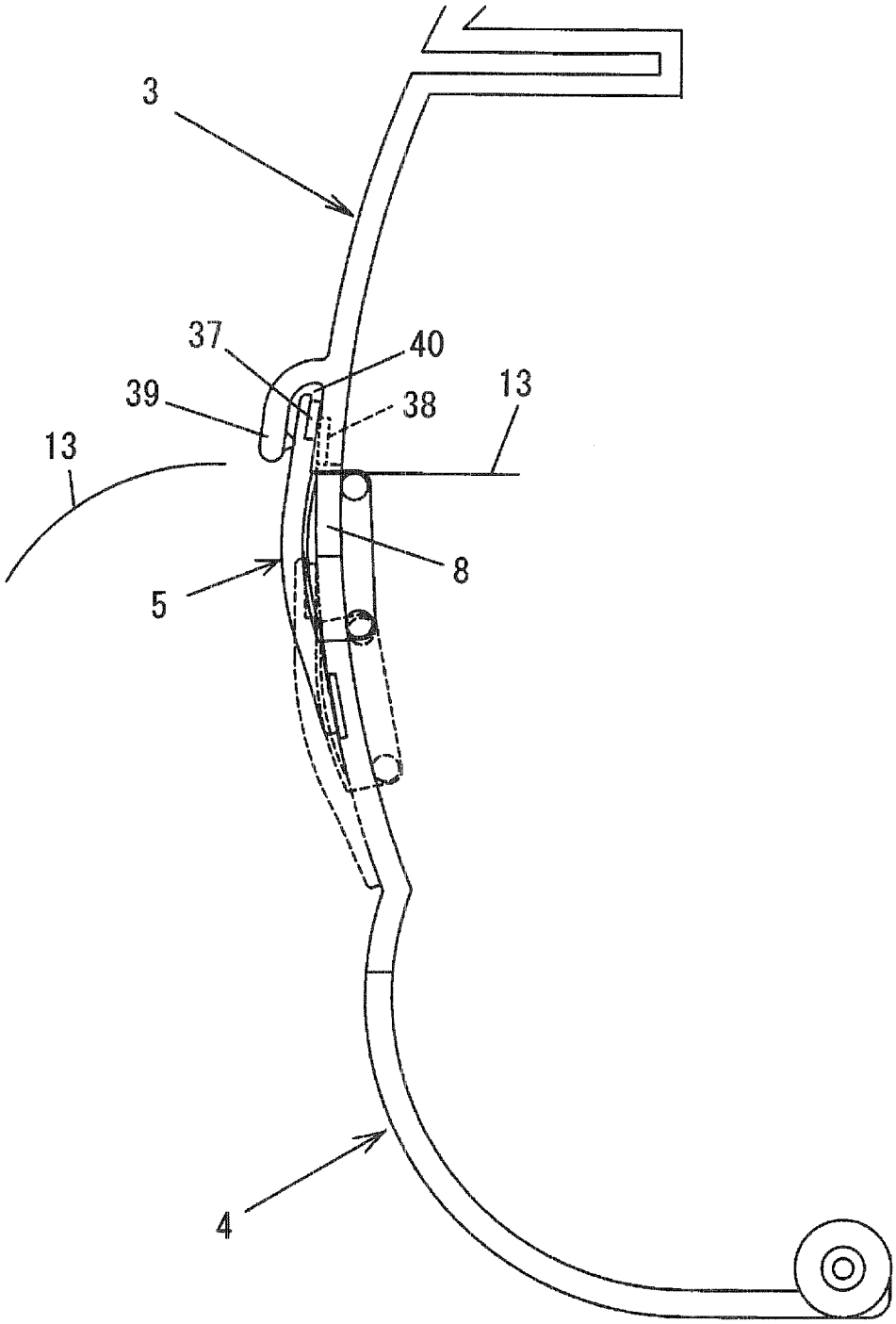
FIG. 9 is a diagram showing a modified example of the portable printer 1.

FIG. 9 is a diagram showing a modified example of the portable printer 1. In FIG. 9, the same components as those of the portable printer 1 shown in FIGS. 1 to 7 are designated by the same reference numerals, and the description of such components will not be repeated here.

In the modified example shown in FIG. 9, a hand cutter blade 37 for cutting the paper by hand is attached to the upper edge of the paper exit cover 5 which corresponds to the lower edge of the paper exit port 8. A protective edge 39 is formed in overhanging fashion on the body case 3 thereby forming a space 40 into which the upper edge of the paper exit cover 5 is accommodated. Accordingly, when the paper exit cover 5 is closed, the hand cutter blade 37 is not exposed. Furthermore, since the upper edge of the paper exit cover 5 enters the space formed under the protective edge 39 and is held fixedly therein, the storage cover 4 can be locked in position, thus preventing it from accidentally opening with respect to the body case 3.

Alternatively, the hand cutter blade may be attached to the body case 3, as shown by a dashed line 38 in FIG. 9. In this case, it is preferable to dispose the hand cutter blade 38 inwardly of the lower end of the protective edge 39 in order to prevent the fingers of the operator from touching the blade.

In the above embodiment, the paper exit cover 5 has been described as being attached to the storage cover 4, but the paper exit cover 5 may be attached to the body case 3 by forming the body case 3 so as to have a structure corresponding to the rectangular cutout 29. This offers the further advantage of stabilizing the working of the paper exit cover 5 because, unlike the case of the storage cover 4, the body case 3 is not movable.

When attaching the paper exit cover 5 to the body case 3, if the paper exit cover 5 is formed so that the lower end thereof engages with the storage cover 4 not only when the paper exit port 8 is closed but also when it is opened, the paper exit cover 5 can be made to also function as a lock member for preventing the storage cover 4 from accidentally opening.

In the above embodiment, the paper exit cover 5 has been described as being moved in sliding fashion using the rollers 32, but the paper exit cover 5 may be attached to the storage cover 4 or the body case 3 in other suitable ways, as long as the paper exit cover 5 can be made movable in sliding fashion. For example, grooves may be formed in the body case 3 so that the paper exit cover 5 moves in sliding fashion with the portions at both ends thereof engaging with the grooves.

In the above embodiment, use has been made of the microswitch 36, but the mechanism for turning the power on and off to the portable printer 1 in conjunction with the opening and closing operation of the paper exit cover 5 is not limited to the microswitch, and use may be made of any other suitable ON/OFF switch such as a magnetic switch.

According to the portable printer described above, the usability of the portable printer that is often used outdoors by meter reading personnel, home-delivery service personnel, etc. can be improved, and at the same time, the durability of the portable printer can be increased.

What is claimed is:

1. A portable printer comprising:

a body case having a paper storage section for storing paper;

a storage cover rotatably attached to said body case in order to open and close said paper storage section;

a paper exit cover for opening and closing a paper exit port formed between said body case and said storage cover; and a control unit for controlling ON/OFF of power to said portable printer in conjunction with the opening and closing of said paper exit cover, wherein said control unit turns off power to said portable printer when said paper exit cover is set to close said paper exit port, and wherein said paper exit cover is attached to said body case so as to be slidable along said body case.

2. The portable printer according to claim 1, wherein when said storage cover is closed, a front surface of said body case forms substantially the same plane as a front surface of said storage cover.

3. The portable printer according to claim 1, further comprising a hand cutter blade attached to an edge of said body case or to an edge of said paper exit cover.

4. A portable printer comprising:

a body case having a paper storage section for storing paper;

storage cover rotatably attached to said body case in order to open and close said paper storage section;

a paper exit cover for opening and closing a paper exit port formed between said body case and said storage cover; and a control unit for controlling ON/OFF of power to said portable printer in conjunction with the opening and closing of said paper exit cover, wherein said control unit turns off power to said portable printer when said paper exit cover is set to close said paper exit port, and wherein said paper exit cover is attached to said storage cover so as to be slidable along said storage cover.

5. The portable printer according to claim 4, wherein when said storage cover is closed, a front surface of said body case forms substantially the same plane as a front surface of said storage cover.

6. The portable printer according to claim 4, further comprising a hand cutter blade attached to an edge of said body case or to an edge of said paper exit cover.

7. A portable printer comprising:

a body case having a paper storage section for storing paper;

a storage cover rotatably attached to said body case in order to open and close said paper storage section;

a paper exit cover for opening and closing a paper exit port formed said body case and said storage cover;

a control unit for controlling ON/OFF of power so said portable printer in conjunction with the opening and closing of said paper exit cover, wherein said control unit turns off power to said portable printer when said paper exit cover is set to close said paper exit port; and a warning unit which issues a warning at predetermined intervals of time when said paper exit cover is set to open said paper exit port.

8. The portable printer according to claim 7, wherein when said storage cover is closed, a front surface of said body case forms substantially the same plane as a front surface of said storage cover.

9. The portable printer according to claim 7, further comprising a hand cutter blade attached to an edge of said body case or to an edge of said paper exit cover.

* * * * *